United States Patent [19]

Strop

[11] 4,147,357

[45] Apr. 3, 1979

[54] GOLF PUTTER HEAD

[76] Inventor: William H. Strop, 1st Federal Bldg., 7th and Felix Sts., St. Joseph, Mo. 64501

[21] Appl. No.: 816,500

[22] Filed: Jul. 18, 1977

[51] Int. Cl.[2] ..... A63B 53/04

[52] U.S. Cl. ..... 273/164

[58] Field of Search ..... 273/77 R, 80 C, 80.2, 273/164, 167–174, 183 D, 162 E; D34/5 GH

[56] References Cited

U.S. PATENT DOCUMENTS

| | | | |
|---|---|---|---|
| D. 91,336 | 1/1934 | Thompson | 273/167 G X |
| D. 211,100 | 5/1968 | Baker | 273/164 X |
| D. 220,844 | 6/1971 | Letters | 273/80 C X |
| D. 223,031 | 2/1972 | Ernst | 273/80 C X |
| 687,539 | 11/1901 | Palmer | 273/80.2 |
| 786,268 | 4/1905 | Corey et al. | 273/164 X |
| 2,478,468 | 8/1949 | Drake | 273/80.2 |
| 2,644,689 | 7/1953 | Putnam | 273/167 G X |
| 3,042,409 | 7/1962 | Johnson | 273/164 |
| 3,779,398 | 12/1973 | Hunter | 273/162 E X |
| 3,876,211 | 4/1975 | Caligiuri | 273/164 X |
| 3,880,430 | 4/1975 | McCabe | 273/164 X |
| 3,992,015 | 11/1976 | Benson | 273/80.2 |

FOREIGN PATENT DOCUMENTS

| | | | |
|---|---|---|---|
| 558183 | 1/1975 | Switzerland | 273/80 C |
| 1232651 | 5/1971 | United Kingdom | 273/80.2 |

*Primary Examiner*—Richard J. Apley
*Attorney, Agent, or Firm*—John H. Widdowson

[57] ABSTRACT

A golf putter head for mounting on a golf club shaft of a putter. The putter head having an inverted "Y" shaped yoke attached to both ends of a semi-circular base used for putting a golf ball.

6 Claims, 5 Drawing Figures

GOLF PUTTER HEAD

BACKGROUND OF THE INVENTION

This invention relates generally to a golf club head and more particularly, but not by way of limitation, to a club head for a putter.

Heretofore, there have been numerous types and designs of golf club putter heads. The putter heads generally are attached at one end to the end of a golf club shaft. Also, the end of the golf shaft may be attached to the center of the putter head.

There are also prior art putter heads wherein the center of the head is marked by a line or depression for centering the head in front of the golf ball.

None of the prior art putters disclose the novel and unique structure of the subject golf club putter head and the advantages thereof.

SUMMARY OF THE INVENTION

The subject invention provides a golf club putter head for the centering of the golf club in front of a golf ball and improved accuracy in putting.

Because of the unique structure of the putter head, the torque or twisting of the head caused by the off center stroking of the golf ball is greatly reduced. The putter head also provides an enlarged "sweet spot" which is the area in the center of the face of a club head where the golf ball is correctly hit. The club head is balanced so that the golf shaft rests comfortably in the golfer's hand when the putter head is placed on the ground surface adjacent the golf ball.

The bottom portion of the club head is semi-circular with the ends curved upwardly thereby minimizing the area on the bottom of the head which contacts the ground surface and reduces the drag or the stubbing of the putter head during the back and forward swing of the putter.

The rear of the bottom portion of the putter head base is angled upwardly to minimize the tendency to stub the putter head against the grain of the grass during the backstroke of the putter.

The putter head is made of a heavy soft bronze for providing a solid feel when contacting the golf ball and preventing the golf ball from springing or caroming of the face plate of the putter which is typical in most putters.

The top and rear portion of the base are hollowed out for balance and providing a thin sole in the bottom of the base which in turn provides means for scooping the golf ball from the ground surface or the golf hole and cradling the golf ball thereon between the toe and heel portion of the base. By hollowing out the top and rear portion of the base, the weight is distributed in the toe and heel portion of the base. Also, the front portion of the base is provided with a thin bladed face plate surface which is the "sweet spot" area in the center of the front portion. Because of the difference in thickness of the "sweet spot" area compared to the toe and heel portion of the base, a different sound occurs when correctly hitting the golf ball as compared to incorrectly hitting the golf ball on the weighted toe and heel area.

The golf putter head includes a base having a top portion, a bottom portion, a toe portion, a heel portion, a front portion, and a rear portion. The top portion is horizontally disposed with the bottom portion formed in a semi-circle with the ends extending upwardly meeting the ends of the horizontal top portion. The front portion is vertically disposed and forms a face plate for striking the golf ball. An inverted "Y" shaped yoke is included having a neck portion with a forward arm and rearward arm extending downwardly therefrom. The end of the forward arm is attached to the top of the toe portion of the base. The end of the rearward arm is attached to the top of the heel portion of the base. The forward arm includes a slot therein for centering the line of sight over a depression in the center of the base.

The advantages and objects of the invention will become evident from the following detailed description when read in conjunction with the accompanying drawings which illustrate the preferred embodiments of the invention.

DETAILED DESCRIPTION OF THE DRAWINGS

Figure 1:
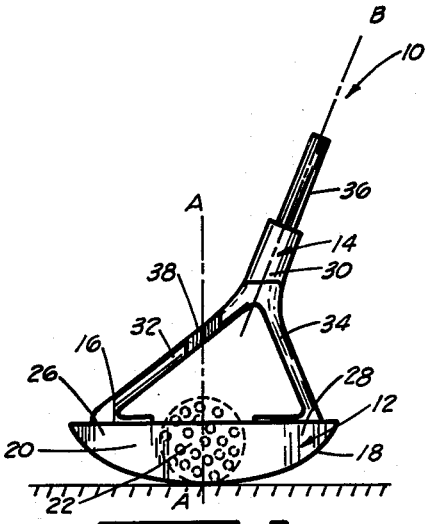
In FIG. 1, a front view of the golf putter head is illustrated.

In FIG. 1, the golf putter head is designated by general reference numeral 10. The putter head 10 includes a base 12 and an inverted "Y" shaped yoke 14.

The base 12 includes a horizontal top portion 16, a semi-circular bottom portion 18 with the ends of the bottom portion 18 extending upwardly contacting the ends of the horizontal top portion 16. The base 12 further includes a vertical front portion 20 which is used as a face plate for contacting a golf ball 22 shown in dotted lines, a rear portion 24 shown in FIG. 2, a toe portion 26 and a heel portion 28. The semi-circular bottom portion 18 provides a minimum contact area of the ground surface. The contact area being in the center of the bottom portion 18.

The yoke 14 includes a neck portion 30 with a downwardly extending forward arm 32 and a rearward arm 34. The end of the forward arm 32 is attached to the top of the toe portion 26 of the base 12. The end of the rearward arm 34 is attached to the top of the heel portion 28 of the base 12. Extending upwardly and at an angle from the vertical is an internal hosel 36 which is used for inserting into the end of a golf club shaft for securing the putter head 10 to the golf club shaft. The golf club shaft is not shown in the drawings.

In FIG. 1, a vertical center line A—A is shown through the center of the base 12. The golf ball 22 is shown centered on the vertical center line A—A. A slot 38 is formed in the forward arm 32 of the yoke 14 for centering the line of sight over the top of the putter head 10 and in front of the golf ball 22.

Also shown is a center line B—B through the neck portion 30 and hosel 36. It should be noted that line B—B is at an angle from the vertical center line A—A so that when the golf shaft is gripped, the hands of the user of the putter are not positioned directly over the putter head 10.

It should be noted that the yoke 14, by attaching the toe portion 26 and the heel portion 28 of the base 12 to the arms 32 and 34, provides a rigid frame for supporting and stabilizing the putter head 10 when contacting the golf ball 22 thereby greatly reducing a twisting and resultant torque of the putter head 10 when an off center putt is made.

Figure 2:
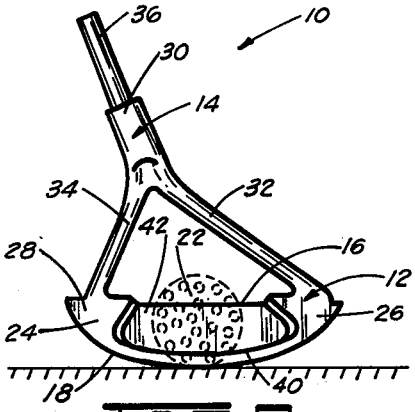
In FIG. 2, a rear view of the putter head is illustrated.
Figure 5:
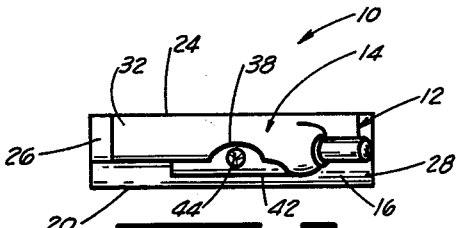
FIG. 5 is a top view of the putter head.

In FIG. 2, the top portion 16 and the top of the rear portion 24 of the base 12 can be seen with a hollowed out portion which forms a thin bladed sole 40 in the bottom portion 18 of the base 12. The hollowing out of the center of the base 12 also provides a thin bladed face plate surface 42 which is part of the front portion 20 and is also shown in FIG. 5. The thin bladed face plate surface 42 in the front portion 20 provides an enlarged "sweet spot" area which is the desired area in the center of the base 12 for hitting the ball 22. Because of the difference in the thickness of the "sweet spot" area, a different sound is heard when striking the golf ball 22 as opposed to when the golf ball is incorrectly hit near the toe portion 26 or heel portion 28 of the base 12. The sound indicates to the user of the putter if he has correctly hit the ball.

By providing the thin bladed sole 40 in the bottom portion 18 of the base 12, the base 12 can be used for scooping the golf ball 22 out of the golf hole or from the ground surface and allows the golf ball 22 to be cradled on top of the base 12.

The hollowing out of the base 12 distributes the majority of the weight in the heel portion 28 and toe portion 26 of the base 12. The balancing of the weight at both ends of the base 12 allows the putter head 10 to be more easily centered in front of the golf ball 22.

Figure 3:
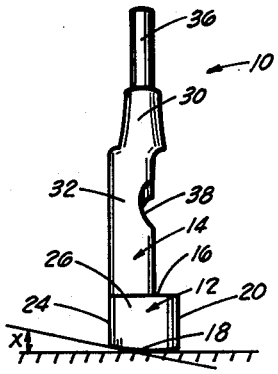
FIG. 3 is an end view of the putter head.

In FIG. 3, an end view of the putter head 10 is illustrated. In this view the bottom of the rear portion 24 of the base 12 can be seen angled upwardly at an angle X from the horizontal ground surface. This upwardly angled surface reduces the tendency to stub the back of the putter head 10 during the back stroke of the putter and greatly improves the ease in the putter swing. Also seen in this view is the slot 38 which is formed in a half moon shaped along one side of the forward arm 32 of the yoke 14.

Figure 4:
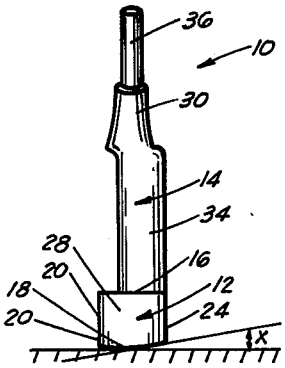
FIG. 4 is an opposite end view of the putter head.

In FIG. 4, an opposite end view of the putter head 10 is illustrated. In this view the rearward arm 34 can be seen attached to the top of the heel portion 28 of the base 12.

In FIG. 5, a top view of the putter head 10 is illustrated. In this view the thin bladed face plate surface 42 of the front portion 20 of the base 12 can be seen disposed between the toe portion 26 and the heel portion 28 of the base 12.

Positioned in the center of the top of the base 12 is a depression 44 which is drilled therein. The depression 44 is used for centering the center of the base 12 with the half moon shaped slot 38 in the forward arm 32 of the yoke 14. By centering the depression 44 with the slot 38, the vertical line of sight of the user of the putter is properly positioned for centering in front of the golf ball 22 so that the user of the putter is assured of hitting the golf ball 22 in the center of the front portion 20 of the base 12.

The putter head 10 is made preferably of a soft red bronze providing a solid feel when contacting the golf ball as opposed to a spring or carom type of feel when contacting a golf ball with a putter made of harder brass, bronze, steel alloys, or the like. While a soft bronze is preferable, it is understood that other types of base metals could be used equally well to provide a similar feel when the putter head 10 contacts the golf ball 22.

Changes may be made in the construction and arrangement of the parts or elements of the embodiment as disclosed herein without departing from the spirit or scope of the invention as defined in the following claims.

I claim:

1. A golf putter head for mounting on a golf club shaft of a putter, the putter head used for putting a golf ball on a putting surface, the putter head comprising:

a base, said base having a top portion, a bottom portion, a toe portion, a heel portion, a front portion, and a rear portion, the top portion horizontally disposed, the bottom portion semi-circular with the ends thereof extending upwardly joining the ends of the top portion, the front portion vertically disposed and forming a face plate for striking the golf ball;

sighting means formed in said base and centered thereon;

an inverted "Y" shaped yoke having a neck portion with a forward arm and a rearward arm, the forward arm extending downwardly above the center of said base with the end of the forward arm attached to the top of the toe portion of said base, the rearward arm extending downwardly with the end of the rearward arm attached to the top of the heel portion of said base; and sighting means formed in said yoke centered above said sighting means on said base when the putter head is balanced on top of the putting surface and said sighting means are in alignment.

2. The putter head as described in claim 1, wherein the neck portion of said yoke further includes an upwardly extending hosel for attaching the putter head to the golf club shaft.

3. The putter head as described in claim 1, wherein the center of the top portion and the rear portion of said base are hollowed out for balancing the weight of the putter head with the weight distributed in the toe and the heel portion of said base.

4. The putter head as described in claim 1, wherein the bottom of the rear portion of said base is angled upwardly from the horizontal for ease in moving the putter head during the back swing of the putter.

5. A golf putter head for mounting on a golf club shaft of a putter, the putter head used for putting a golf ball on a putting surface, the putter head comprising:

a base, said base having a horizontal top portion, a semi-circular bottom portion with the ends of the bottom portion angled upwardly joining the ends of the top portion of said base, a toe portion, a heel portion, and a vertical front portion forming a face plate for striking the golf ball;

a depression formed in the top portion of said base and centered thereon;

an inverted "Y" shaped yoke having a neck portion with a forward arm and a rearward arm, the forward arm extending downwardly above the center of said base with the end of the forward arm attached to the top of the toe portion of said base, the rearward arm extending downwardly with the end of the rearward arm attached to the top of the heal portion of said base; and a slot in the side of the forward arm of said yoke, said slot centered above said base and in alignment with the depression in the top portion of said base when the putter head is balanced on top of the putting surface.

6. The putter head as described in claim 5, wherein the putter head is balanced by hollowing out the center of the top portion and the rear portion of said base so that the weight is distributed in the toe and the heel portion of said base.

* * * * *